US006592002B2

(12) United States Patent
Clark et al.

(10) Patent No.: US 6,592,002 B2
(45) Date of Patent: Jul. 15, 2003

(54) DISPENSER FOR DISPENSING A STACK OF FOLDED SHEET PRODUCTS

(75) Inventors: Gerald L. Clark, Tucker, GA (US); Antwain D. Taylor, Suwanee, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 67 days.

(21) Appl. No.: 10/052,918

(22) Filed: Oct. 29, 2001

(65) Prior Publication Data

US 2003/0080137 A1 May 1, 2003

(51) Int. Cl.[7] ..... A47K 10/24
(52) U.S. Cl. ..... 221/46; 221/197
(58) Field of Search ..... 221/33, 45, 46, 221/48, 62, 197, 287; 312/50, 60; 206/449, 556, 494

(56) References Cited

U.S. PATENT DOCUMENTS

| | | | | |
|---|---|---|---|---|
| 4,678,099 | A | * 7/1987 | Matsui | 221/48 |
| 4,953,747 | A | 9/1990 | Wenkman et al. | |
| 5,076,466 | A | 12/1991 | Petterson et al. | |
| 5,265,758 | A | 11/1993 | Saint Criq et al. | |
| 5,642,836 | A | 7/1997 | Merriweather, Jr. | |
| 5,697,576 | A | 12/1997 | Bloch et al. | |
| 5,868,342 | A | 2/1999 | Moody et al. | |
| 5,931,339 | A | 8/1999 | Dodge et al. | |
| 5,950,863 | A | 9/1999 | Schutz et al. | |
| 5,954,256 | A | 9/1999 | Niada | |
| 6,070,756 | A | 6/2000 | Dodge et al. | |
| 6,145,782 | A | 11/2000 | King et al. | |
| 6,170,698 | B1 | 1/2001 | Phelps et al. | |
| 6,267,323 | B1 | 7/2001 | Phelps et al. | |

FOREIGN PATENT DOCUMENTS

| | | |
|---|---|---|
| EP | 0729724 | 9/1996 |
| WO | WO 9709918 | 3/1997 |
| WO | WO 9840002 | 9/1998 |
| WO | WO 9933384 | 7/1999 |

* cited by examiner

*Primary Examiner*—Kenneth W. Noland
(74) *Attorney, Agent, or Firm*—Dority & Manning

(57) ABSTRACT

A dispenser for dispensing individual sheets of a paper product from a stack of sheets includes an external housing having a bottom opening. A module is slidably received in the compartment through the bottom opening. The module is sized for receipt of a stack of the folded paper products. The module is moveable vertically within the compartment between a loaded position wherein the module is inserted substantially entirely within the compartment, and a refill position wherein the module is slid vertically down and out of the compartment a sufficient distance for reloading the module with a refill stack of the sheets. A latch mechanism releasably holds the module within the housing at the loaded position.

34 Claims, 7 Drawing Sheets

FIG. 3C
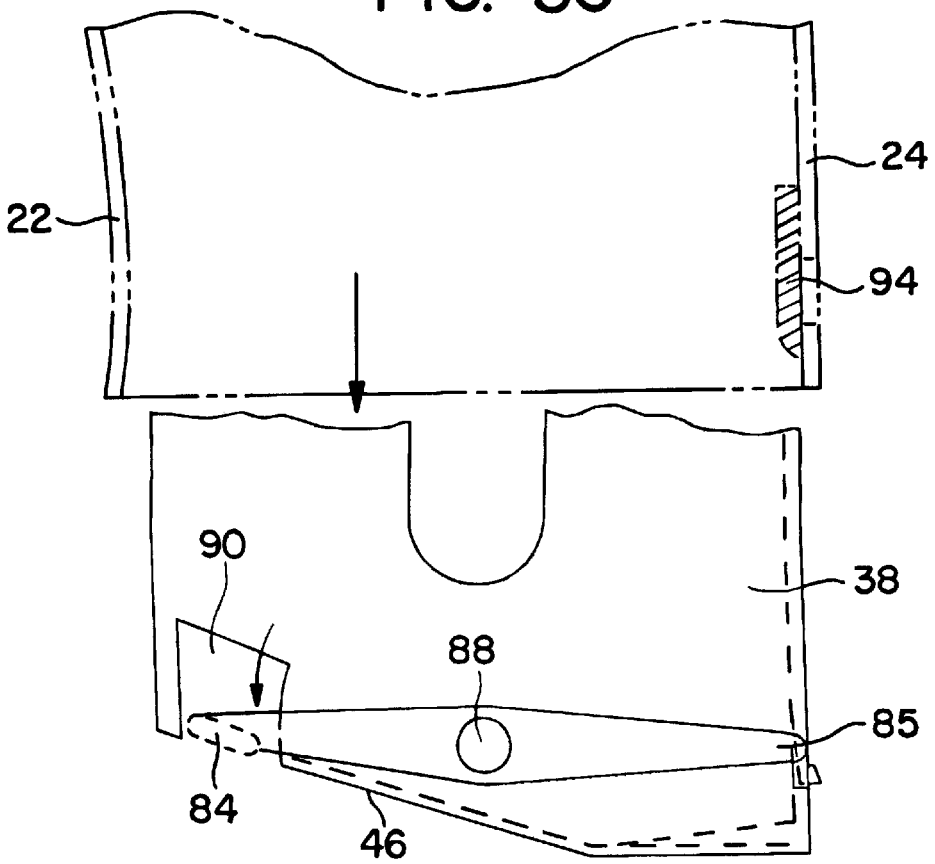
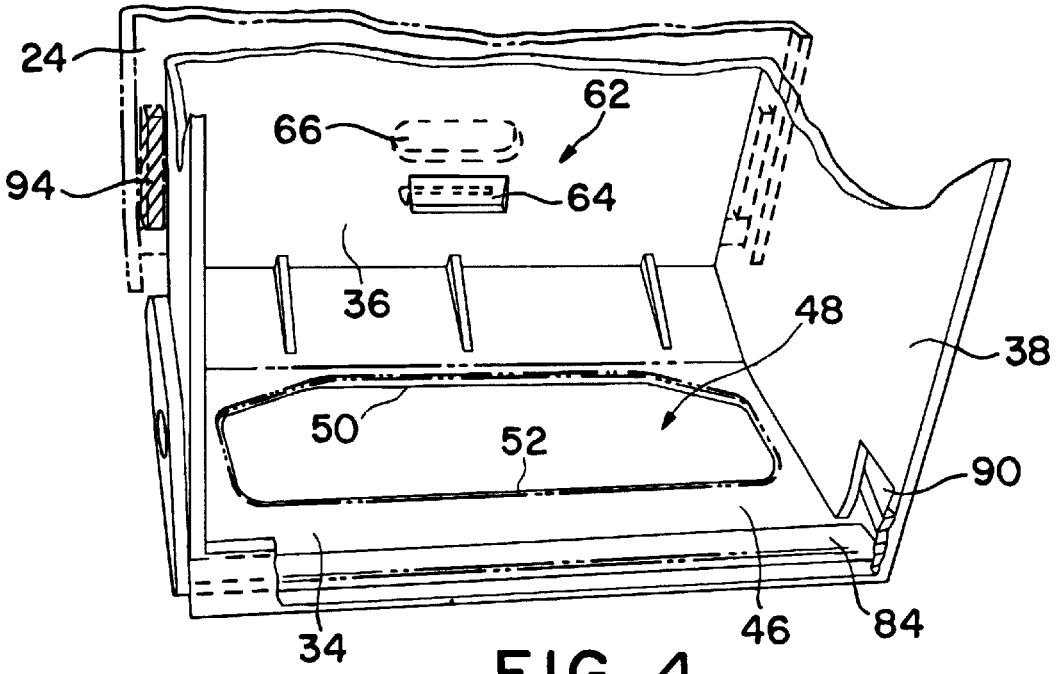
FIG. 4

DISPENSER FOR DISPENSING A STACK OF FOLDED SHEET PRODUCTS

BACKGROUND

Dispensers and cabinets for dispensing individual sheets of paper products, for example toilet tissue, from an internally stored stack of the products are known in the art. Commercial examples of such dispensers include the line of SaniTouch® bath tissue dispensers from Kimbery-Clark Corporation. The industry is continuously seeking ways to improve such dispensers, especially as to ease and reliability of use by the public, and simplicity and cost from a manufacturing standpoint.

Particular problems arise in use of such cabinets or dispensers for stacks of relatively high absorbency and low tensile strength paper products, such as bath or toilet tissue. For example, when a maintenance technician over-fills or "stuffs" the dispenser upon refilling, the stack becomes compressed against the bottom dispensing surface and it becomes very difficult for a user to pull individual sheets out of the dispensing throat. The sheets will tear and the user is tempted to grasp and pull "clumps" of the product out of the dispenser. Preventing over-fill conditions is an ongoing issue and at least one solution is described in U.S. Pat. No. 4,938,382. The '382 patent describes a dispenser for stacked folded sheets incorporating a mechanical anti-stuff feature to relieve compressive pressure in the stack resulting from an over fill condition.

Conventional dispensers also typically include front doors or panels that swing open to provide access for refilling the dispenser. This requires space for the door or panel to swing to the fully open position, thus limiting use of the dispensers in relatively tight confined spaces. Also, locks and key mechanisms must be provided to secure the door or panel and to deter vandalism. Such devices add to manufacturing costs, must be serviced and maintained, and require the maintenance personnel to keep track of keys and the like for opening the dispenser.

The industry is constantly seeking improved dispensers, particularly for dispensing stacked sheets of bath or toilet tissue. The present invention offers such an improved dispenser and addresses certain noted drawbacks of conventional dispensers.

SUMMARY

Objects and advantages of the invention will be set forth in detail in the following description, or may be obvious from the description, or may be learned through practice of the invention.

In accordance with the invention, a dispenser is provided for dispensing individual sheets of paper product from a stack of such sheets. The dispenser is not limited to any specific type of paper product, but is particularly suited for dispensing bath tissue and toilet tissue. The dispenser includes an external housing defining an internal compartment with a bottom opening provided therein. The shape and configuration of the external housing is not a limiting feature of the invention, and the external housing may take on any aesthetic shape and may be made of any suitable material.

In one embodiment of the invention, a module is slidably received in the housing compartment through the bottom opening. The module is sized to receive a stack of the folded sheet products to be dispensed. For example, the module may have side walls, a bottom surface, and a back wall defining a generally elongated stack location for loading a stack of the paper products into the module. The bottom surface of the module is provided with a dispensing throat. The throat may take on various configurations and, in one particular embodiment, the throat has a generally trapezoidal shape.

The module is moveable vertically within the housing compartment from a loaded position wherein, in one embodiment, the module is inserted substantially entirely within the compartment with the dispensing throat being accessible to a user through the bottom opening of the housing. The module is vertically moveable from the loaded position to a refill position wherein the module is slid down and out of the compartment a sufficient distance to allow a maintenance technician to load a refill stack of the paper products into the module. Once the module is refilled, the maintenance technician simply pushes the module vertically back up into the housing.

A latch mechanism may be provided between the module and the housing to releasably lock or hold the module within the housing at the loaded position. To release the module from the loaded position, the maintenance technician simply releases the latch mechanism.

The invention contemplates embodiments of the dispenser wherein the housing compartment is sized to receive a single module, or multiple modules. For example, a dual module dispenser is contemplated wherein two modules are received side-by-side within the housing.

In a particularly useful embodiment, the module is slidably and lockingly engaged with the housing so that the module is moveable between the loaded and refill positions without being removed completely from the housing. In other words, in the refill position, the module extends down and out of the housing but is still retained by the housing. In this embodiment, a protrusion or a channel may be provided on one of the walls of the module. The protrusion or channel may lockingly engage with a complimentary channel or protrusion defined on one of the walls of the housing. For example, the module may include a back wall having at least one resilient protrusion extending therefrom. This protrusion may be resilient so as to allow for initial loading of the module into the housing. The protrusion may engage and slide in a channel defined in a back wall of the housing. The protrusion and channel have a shape so that as the module slides vertically down from the loaded position to the refill position, the protrusion slides along the channel. At the end of the channel, the protrusion prevents the module from being pulled or falling out of the housing.

It may also be desired to incorporate a mechanical anti-stuff mechanism in the module to restrict the height of the stack of sheets loaded into the module. This anti-stuff mechanism may take on various designs, and may include known devices. In a particularly unique embodiment of the invention, the anti-stuff feature includes a top plate that moves automatically in the stack location to a reduced vertical height upon movement of the module to the refill position. The plate is held in this position until the module is moved back to the loaded position wherein the plate is released and free to move upwards in the stack location. In this manner, any compressive forces on the stack resulting from an overfill condition are relieved. The top plate may be moved and held by any number of mechanisms, including at least one cam mounted on the module which is in mechanical communication with the top plate. This cam may be contacted and engaged by a cam surface defined on a wall of the housing such that the cam contacts and engages the cam surface upon movement of the module to the loaded position.

According to another unique feature of an embodiment of the invention, the module may be provided with a moveable stack lift mechanism disposed adjacent to the bottom surface of the module. The lift mechanism may be, for example, a bar disposed across the width of the module forward of the dispensing throat. At least a forward facing portion of the stack of sheets is positioned on top of the lift mechanism upon refilling the module. Upon insertion of the module into the housing to the loaded position, the lift mechanism automatically moves from a first position adjacent the bottom surface of the module to a second position displaced vertically upwards from the bottom surface. In this manner, the portion of the stack resting on the lift mechanism is moved upwards and away from the bottom surface of the module. It has been found that this orientation of the stack within the module relieves compressive forces of the stack against the bottom surface of the module and provides for more efficient dispensing of individual sheets through the dispensing throat. The lift mechanism, i.e. bar, may be actuated or moved by any number of mechanical arrangements. For example, the bar may include side arms that are pivotally mounted to respective sides of the module. The side arms may be engaged and moved by cam surfaces defined on the housing upon movement of the module to the loaded position.

The present invention also includes a stand alone module intended for use in combination with a dispenser housing to dispense a stack of folded sheet products, as discussed above. In other words, an embodiment of the invention is the module without the associated dispenser housing. The module may be configured as described herein.

An alternative embodiment of the invention is any dispenser for dispensing a stack of folded sheet products incorporating the moveable stack lift mechanism as described herein. In other words, the inventive stack lift mechanism may be used in any type of dispenser and is not limited to a module/housing configuration. The invention includes any such uses of the moveable stack lift mechanism.

The invention will be described in greater detail below by way of the appending drawings.

BRIEF DESCRIPTION OF THE DRAWINGS

FIG. 3*c* is a side operational view of the stack lift mechanism as the module is withdrawn from the dispenser housing;

FIG. 4 is a perspective view of the bottom portion of the module particularly illustrating the dispensing throat defined therin;

DETAILED DESCRIPTION

Reference will now be made in detail to one or more embodiments of the invention as illustrated in the figures. Such embodiments are provided by way of explaining the invention and are not meant as a limitation of the invention. It is intended that the present invention include modifications and variations to the embodiments shown and described herein.

Figure 1:
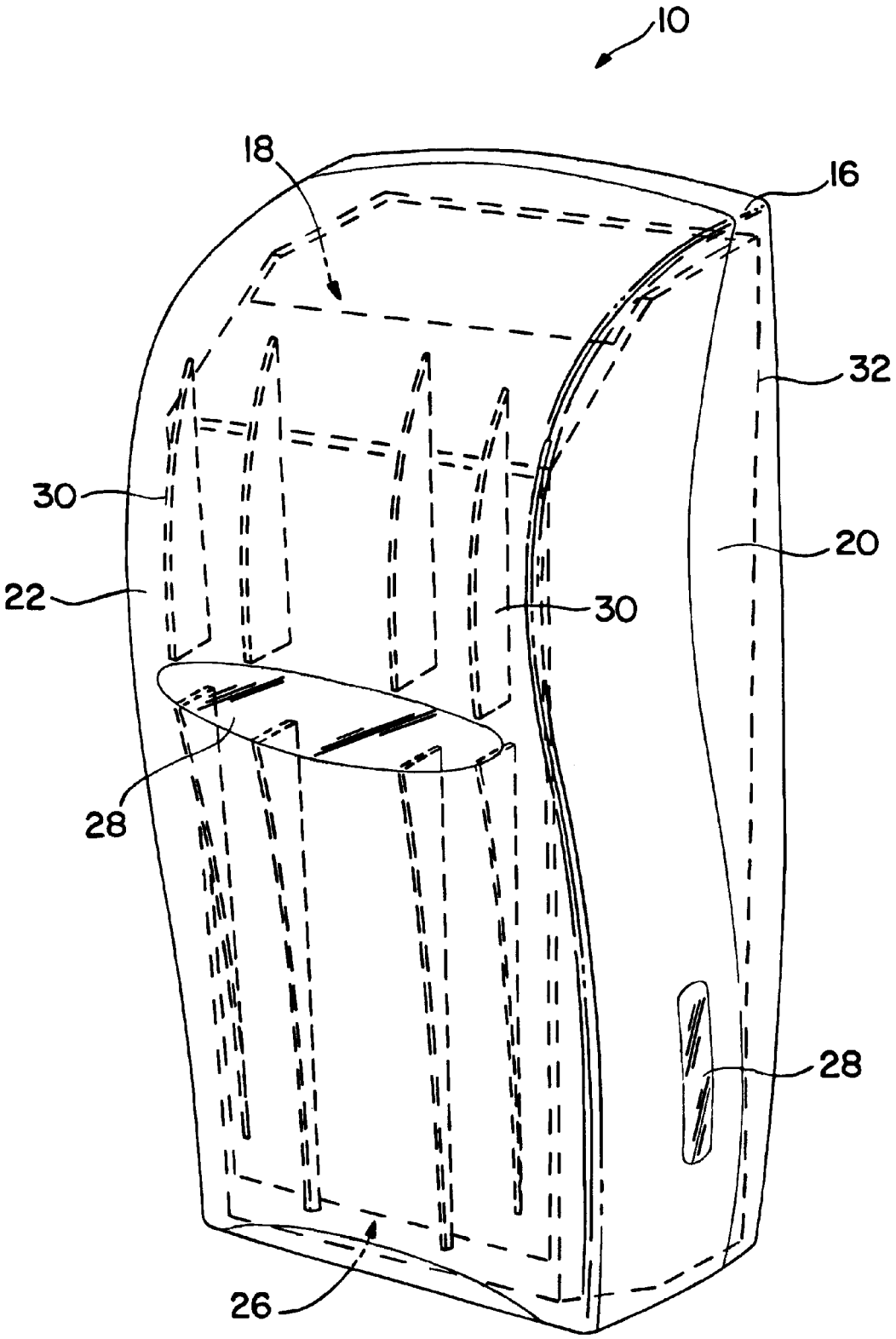
FIG. 1 is a perspective view of a housing for a dispenser according to the invention and illustrates the module contained within the housing in dashed lines.
Figure 2:
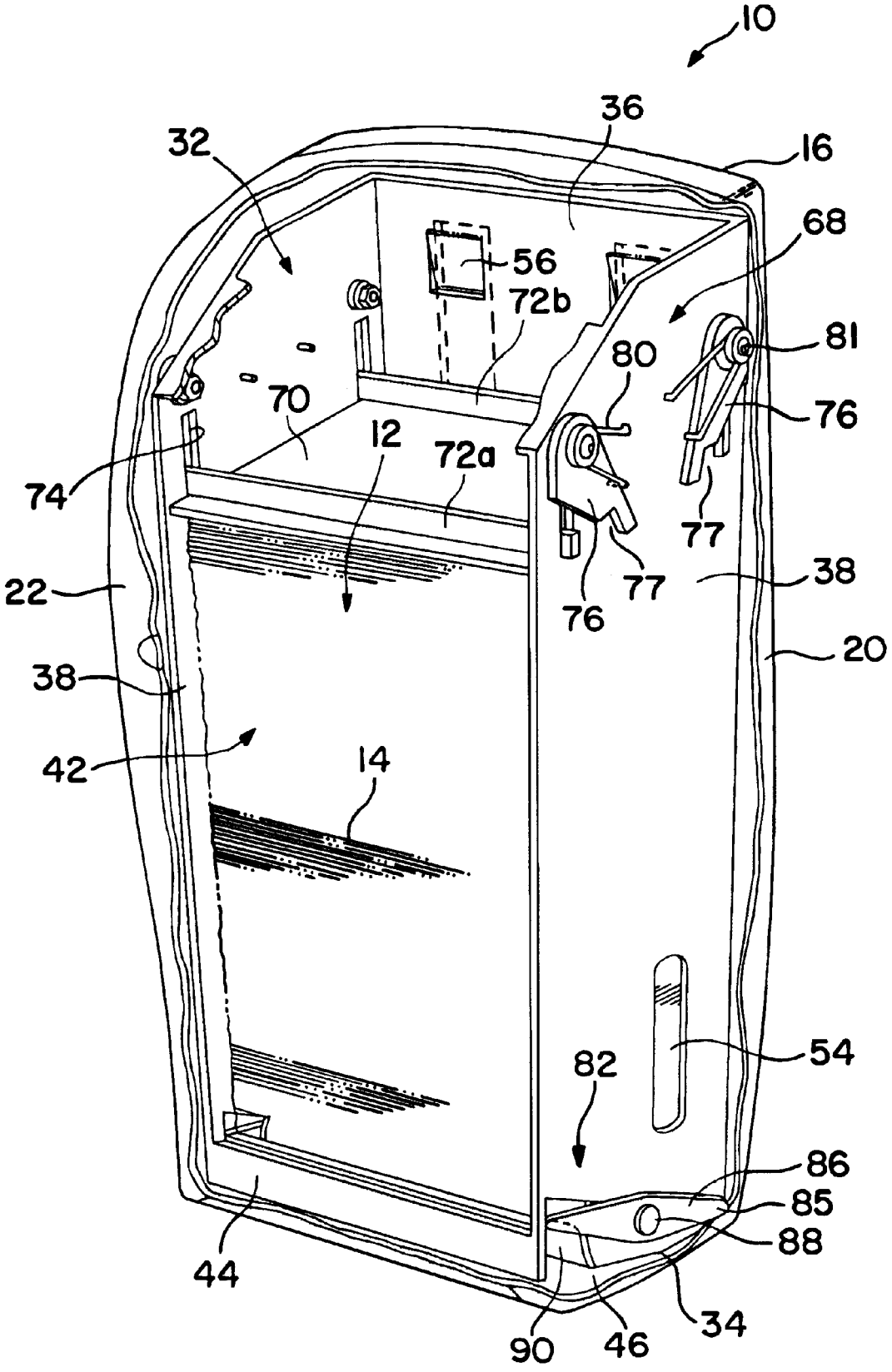
FIG. 2 is a cutaway view of the dispenser shown in FIG. 1 particularly illustrating the module unit contained within the housing.

Referring to FIGS. 1 and 2 in general, a dispenser 10 is provided for dispensing individual sheets 14 of a paper product from a stack 12 of the sheets loaded into the dispenser 10. The dispenser 10 includes an external housing, generally 16, defining an internal compartment 18 with a bottom opening 26 therein. The housing 16 is not a limiting feature of the invention and may take on any shape or configuration. In addition, the housing 16 may be made of any suitable material.

In the illustrated embodiment, the housing 16 includes side walls 20, a front wall 22, and a back wall 24. One or more windows 28 may be provided in any of the walls so that a maintenance technician can easily view the quantity of sheets 14 left in the dispenser. Ribs 30 (FIG. 1) may be provided on the inside surface of the housing front wall 22 in order to help maintain the stack of sheets 12 properly aligned in the vertical stack 12 within the dispenser 10.

Referring to FIG. 2 in particular, a module 32 is removably received in the housing compartment 18. The module 32 is slidably inserted into the compartment 18 through the bottom opening 26 of the housing 16. It should be appreciated that the housing 16 may define more than one compartment 18 so that the dispenser 10 can be configured as a multiple stack dispenser. For example, two or more modules may be inserted side by side into a common housing 16. All such configurations of a multiple stack dispenser are within the scope and spirit of the invention.

The module 32 defines a stack location for receipt of the stack 12 of folded sheets to be dispensed. The module 32 may take on various structural configurations. In the illustrated embodiment, the module 32 includes a bottom surface 34, a back wall 36, and side walls 38. The side walls 38 may extend generally to the height of the back wall 36, and extend at least to a height equal to or greater than the height of the stack 12 loaded into the module 32. The module 32 may contain a relatively open front side 42 with a lower lip 44 extending from the bottom surface 34. This lower lip 44 aids in aligning the bottom most sheets 14 of the stack 12 for proper dispensing through a dispensing throat 48 (FIG. 4) defined in the bottom surface 34 of the module 32.

The module 32 may contain one or more windows or openings 54 (FIG. 2) that align with the windows 28 in the housing 16.

Figure 3A:
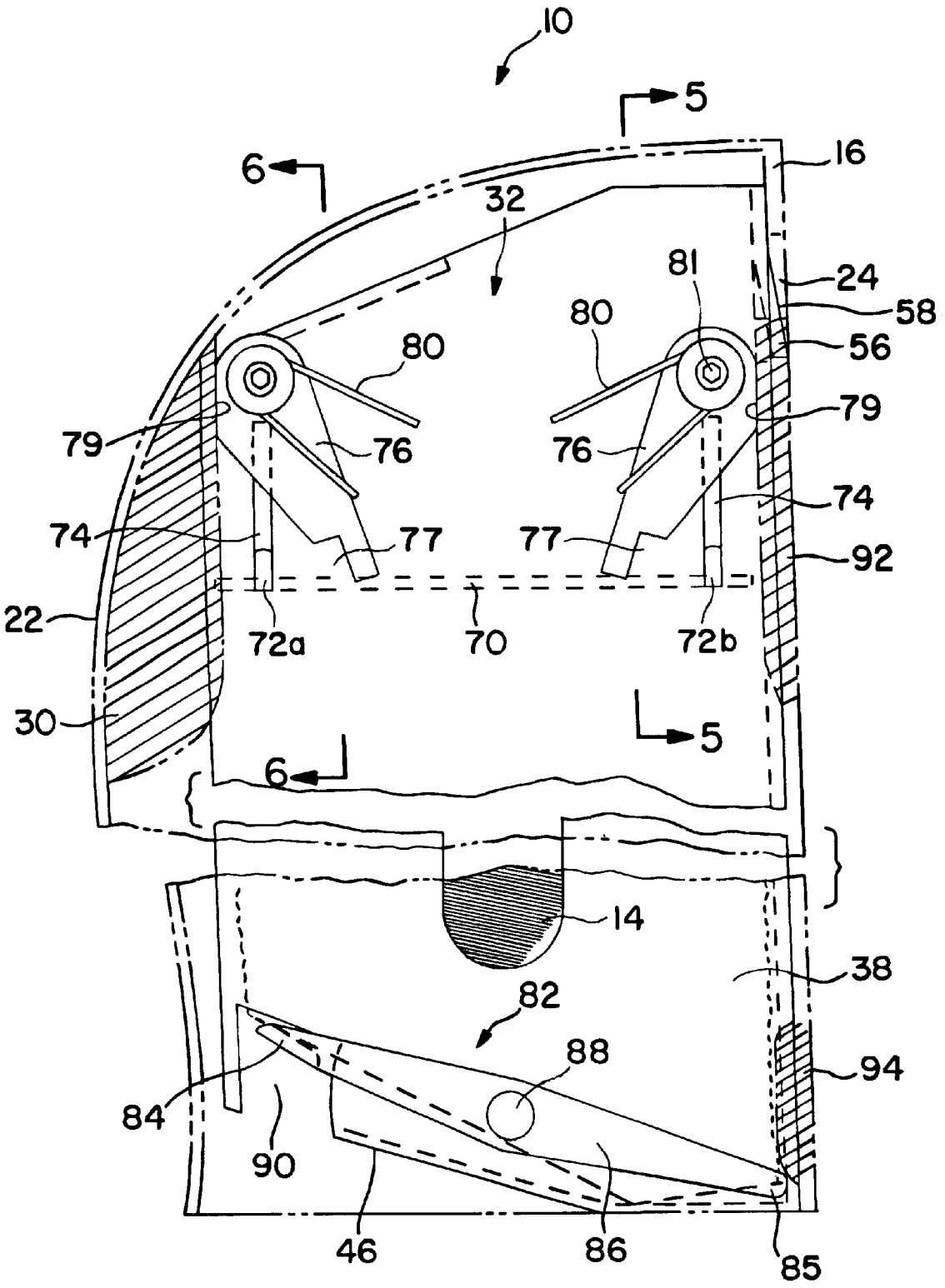
FIG. 3*a* is a side perspective view of the module loaded within the housing and particularly illustrates the stack lift mechanism and anti-stuff feature.
Figure 3B:
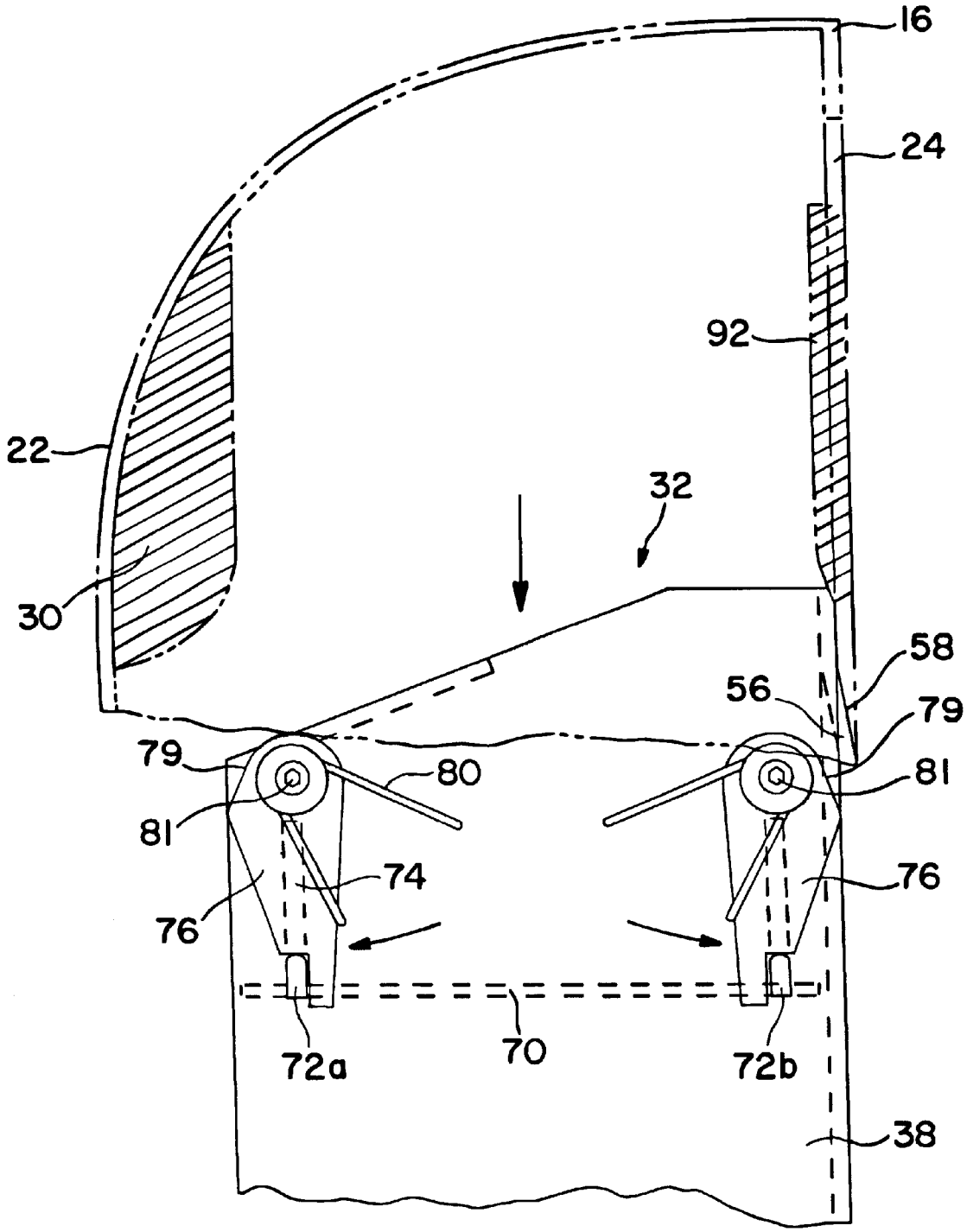
FIG. 3*b* is a side operational view of the module as it is being withdrawn from the dispenser housing.
Figure 5:
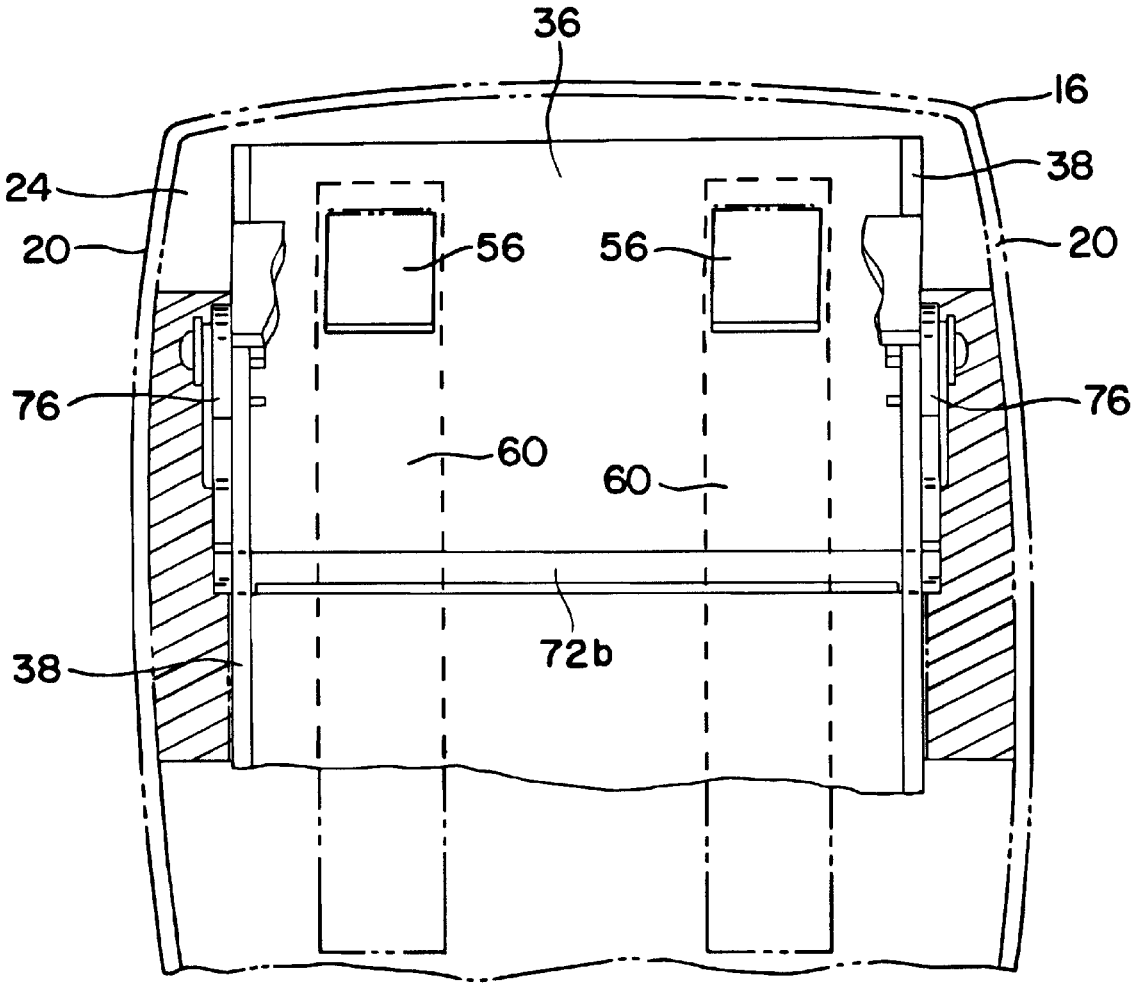
FIG. 5 is a view of the module taken along the lines indicated in FIG. 3*a*.
Figure 6:
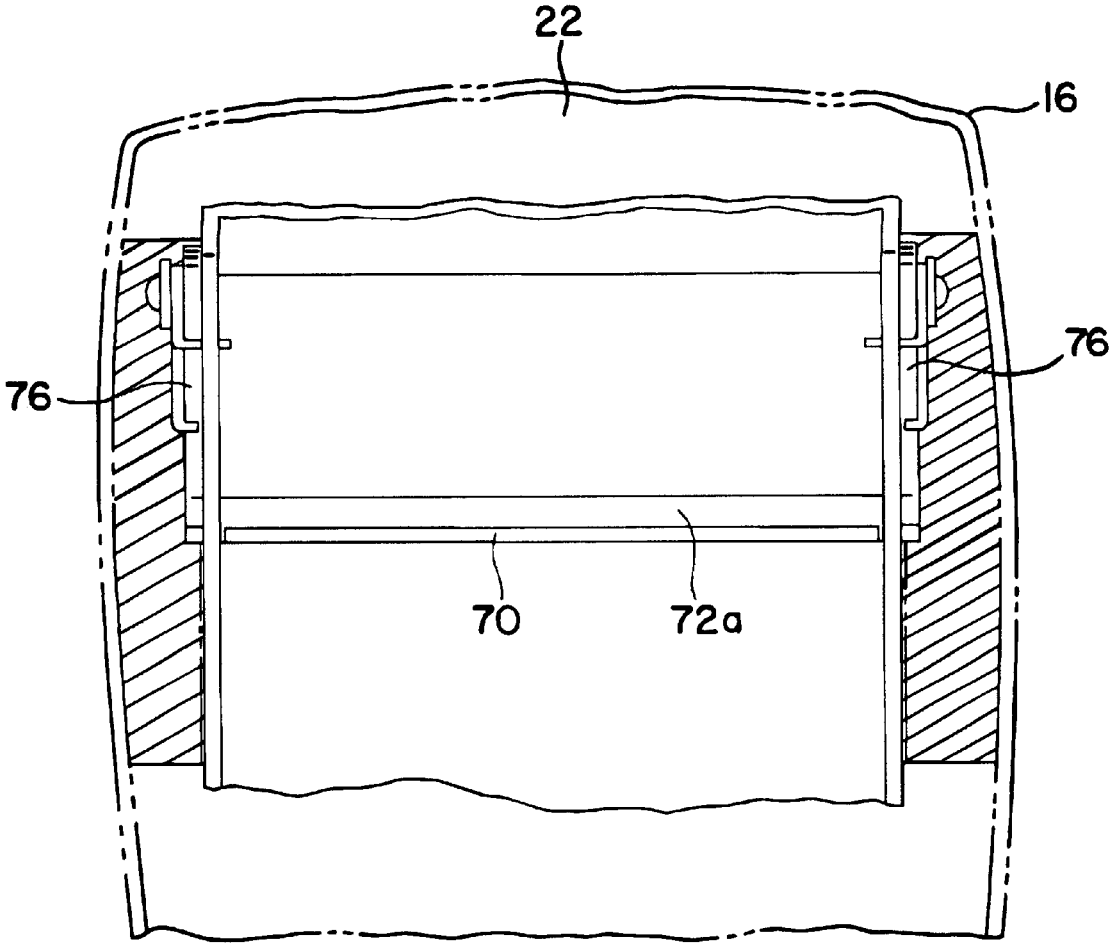
FIG. 6 is a view of the module taken along the lines indicated in FIG. 3*a*.

The module 32 is moveable vertically within the housing compartment 18 between a loaded position illustrated in FIG. 2 and FIG. 3*a* to a refill position illustrated generally in FIGS. 3*b* and 3*c*. In the loaded position, the module 32 may be inserted substantially entirely within the compartment 18 with the dispensing throat 48 accessible to a user through the bottom opening 26 of the housing 16. In the refill position, the module is withdrawn or pulled from the housing 16 at least to the extent that the front open side 42 of the module 32 becomes accessible for loading a refill stack 12 of sheets into the module 32. As will be described in greater detail below, it is not necessary that the module 32 be removed completely from the housing 16 in order to reload the module 32.

A latch mechanism, generally 62 (FIG. 4), is provided in order to releasably secure the module 32 within the housing 16 in the loaded position illustrated in FIG. 2. The latch mechanism may comprise any conventional releasable lock device. In the illustrated embodiment, the latch mechanism 62 includes a resilient tab member 64 provided on the back wall 36 of the module at or adjacent to the bottom edge of the back wall. The tab 64 extends outwardly from the back wall 36 and engages into a recess or opening 66 defined in the back wall 24 of the housing 16. In the loaded position of the module 32, the tab 64 is generally hidden from view yet is accessible to a maintenance technician by simply reaching into the bottom opening 26 of the housing 16 and locating the tab 64 at the back wall of the module 32. To release the module 32, the maintenance technician simply pulls on the tab 64, at which point the module 32 is then free to slide down and out of the housing 16.

It may be desired that the module 32 is slidably and lockingly engaged with the housing 16 so as to be more positively guided as it moves between the loaded and refill positions and also so that the module 32 does not fall from the housing when the latch 62 is released. Any manner of structural engagement between the module 32 and housing 16 may be utilized in this regard. In the illustrated embodiment, the module includes resilient protrusions 56 extending from the back wall 36. These protrusions have an angled back surface 58, as particularly seen in FIG. 3*a*. The protrusions 56 engage in correspondingly sized channels or recesses 60 defined longitudinally in the back wall 24 of the housing 16. The protrusions 56 are preferably angled at surfaces 58 so that upon initial loading of the module 32 within the housing 16, the protrusions 56 are able to flex and slide into the openings or recesses 60. Once the bottom edge of the protrusions 56 have cleared the bottom edge of the recesses 60 upon the initial loading, the protrusions 56 will snap outwardly into the recesses 60. As the module 32 is moved between the loaded and refill positions, the protrusions 56 slide longitudinally along the recesses 60. When the latch mechanism 62 is released, the module is free to move downwards relative to the housing 16 until the bottom edge of the protrusions 56 engage against the bottom edge of the recesses 60. At this point, the module 32 cannot be withdrawn further from the housing 16 and the module is prevented from falling out of the housing 16.

It may further be desired to include an anti-stuff mechanism with the dispenser 10 according to the invention. Various anti-stuff mechanisms are known in the art and any of these devices may be used with the present invention. For example, a suitable mechanism is described and illustrated in U.S. Pat. No. 4,938,382. The '382 patent is incorporated herein by reference for all purposes.

A novel anti-stuff mechanism that may be used with the dispenser 10 is illustrated generally in FIGS. 2 through 3*d*. This unique mechanism, generally 68, includes a top plate member 70 connected to front and rear arms 72*a*, 72*b*. The arms 72*a* and 72*b* extend through slots 74 defined in the side walls 38 of the module, as particularly seen in FIG. 2. The top plate member 70 is thus moveable vertically along the length of the slots 74. In the refill position of the module 32, the top plate 72 is automatically moved to and held at the lower part of the slots 74 and therefore reduces the available height or space for refilling the module 32. This automatic movement may be accomplished by various devices. In the illustrated embodiment, spring loaded cams 76 are provided on the outside surfaces of the module side walls 38. These cams 76 are spring loaded by way of torsion springs 80. The cams 76 rotate about pivot points 81. The cams 76 define recesses 77 into which the end portions of the arms 72*a*, 72*b* extend in the refill position of the module 32.

FIG. 3*a* illustrates the module 32 in the loaded position. In this position, the cams 76 have been rotated by engagement of surfaces 79 with cam surfaces 92 provided on the inside back surface of the housing back wall 24. The cams 76 are rotated against the force of torsion spring 80 and are rotated to a position wherein the recesses 77 have disengaged from the ends of the arms 72*a*, 72*b*. Thus, in this rotated position of the cams 76, the top plate member 70 is free to move vertically upwards to the height extent of the slots 74. The plate 70 will move upwards to relieve any compressive forces on the stack 12 resulting from an attempted overfill of the module 32.

FIG. 3*b* illustrates the module 32 being withdrawn from the dispenser 16 for refilling. As the module 32 is moved downwards, the surfaces 79 of the cam 76 disengage from the cam surfaces 92. At this point, the cams 76 rotate under the influence of the torsion springs 80 and the recesses 77 engage the ends of the arms 72*a*, 72*b*. The top plate 70 is then held in the lowermost position of the slots 74. The top plate 70 will thus be at a reduced vertical height in the module 32 thereby reducing the available vertical space for refilling the module 32. Even if an attempt is made to stuff the module, the reduced vertical height of the top plate 70 ultimately limits the amount of products that can be inserted into the module 32. Upon the top plate being released as described above, any compressive forces on the stack 12 are relieved.

Another unique feature that may be incorporated with a dispenser 10 according to the invention is a moveable stack lift mechanism, generally 82, disposed adjacent to the bottom surface 34 of the module 32. The stack lift mechanism 82 in the illustrated embodiment includes a bar or plate member 84 that extends across the width of the module 32 forward of the dispensing throat 48, as particularly seen in FIG. 4. In the refill position of the module 32, as illustrated in FIG. 4, the bar 84 is essentially directly adjacent to the bottom surface 34 of the module. Thus, the stack 12 of folded sheets is loaded into the module 32 so that at least the forward most portion of the sheets lies on top of the bar 84.

The bar 84 is automatically moveable to an increased height position upon loading the module 32 into the dispenser housing 16. This increased height position is shown particularly in FIGS. 2 and 3*a*. In order to accomplish this automatic movement, the bar 84 may have ends extending through slots 90 defined in the side walls 38 of the module 32, as particularly illustrated in FIGS. 3*a* and 4. These ends are attached to pivotal side arms 86. Side arms 86 are pivotally attached to the side walls 38 by way of any suitable pivot arrangement 88. The opposite ends of the arms 86 define a cam 85 that is engaged by a cam surface 94 provided on the back wall 24 of the housing 16. The cams 85 are engaged by the cam surfaces 94 when the module 32 is inserted into the housing 16 through the bottom opening 26 of the housing. This causes the arms 86 to rotate and the bar 84 to move upwards and away from the bottom surface of the module, as particularly seen in FIG. 3*a*. It has been found that by lifting the forwardmost portion of the stack 12 away from the bottom surface of the module, a more efficient dispensing of the individual sheets is possible.

It should be appreciated that the increase in height of the stack resulting from actuation of the stack lift mechanism 82 must be accommodated by movement of the top plate 70 so that the stack lift mechanism 82 does not compress the stack 12 within the module.

As mentioned, a dispensing throat 48 is provided in the bottom surface 34 of the module. The dispensing throat may take on various configurations. In the illustrated embodiment, the dispensing throat has a generally trapezoidal shape with the longer or wider side 52 being forward of the shorter side 50. The dispensing throat 48 is defined in an angled portion 46 of the bottom surface 34. The angled portion 46 is angled upwards from the back of the module so that the dispensing throat 48 is oriented towards a user standing in front of the dispenser 10. It should be appreciated that any manner of dispensing throat in the bottom surface of the module is within the scope and spirit of the invention.

The present invention also includes the module as described herein as a stand-alone unit for use with any manner of housing.

The present invention also includes any type of dispenser using the unique anti-stuff mechanism and/or stack lift mechanism as described and claimed herein.

It should be appreciated by those skilled in the art that modifications and variations to the embodiments described and illustrated herein can be made by those skilled in the art. It is intended that the present invention include such modifications and variations as come within the scope and spirit of the present invention as set forth in the appended claims.

What is claimed is:

1. A dispenser for dispensing individual sheets of a paper product from a stack of sheets loaded in the dispenser, comprising:

an external housing defining an internal compartment with a bottom opening therein;

a module slidably received in said compartment through said opening, said module sized for receipt of a stack of folded sheets to be dispensed, said module having a bottom surface with a dispensing throat defined therein;

said module movable vertically within said compartment between a loaded position wherein said module is inserted substantially entirely within said compartment with said dispensing throat accessible to a user through said bottom opening, and a refill position wherein said module is slid vertically down and out of said compartment a sufficient distance for reloading said module with a refill stack of the sheets; and a latch mechanism operably disposed between said module and said housing, said latch mechanism releasably holding said module within said housing at said loaded position.

2. The dispenser as in claim 1, wherein said housing compartment is sized to hold a single said module.

3. The dispenser as in claim 1, wherein said housing compartment is sized to hold multiple said modules.

4. The dispenser as in claim 1, wherein said module further comprises a back wall, side walls, and an open front, said side walls extending generally the length of said back wall.

5. The dispenser as in claim 4, wherein said bottom surface of said module is angled so as to present said dispensing throat upwards and towards a user in front of said dispenser.

6. The dispenser as in claim 1, wherein said module is slidably and lockingly engaged with said housing so that said module is movable between said loaded and refill positions without falling from said housing.

7. The dispenser as in claim 6, wherein said module comprises a back wall having at least one protrusion extending therefrom, said protrusion slidably and lockingly engaged in a track defined in a back wall of said housing.

8. The dispenser as in claim 7, wherein said protrusion is resiliently mounted on said module back wall to allow for initial loading of said module into said housing.

9. The dispenser as in claim 1, wherein said latch mechanism comprises a resilient tab disposed on said module, said tab engageable with a recess in said housing and accessible to a maintenance technician from in front of said dispenser.

10. The dispenser as in claim 9, wherein said resilient tab is disposed on a back wall of said module and generally behind said dispensing throat in said bottom surface of said module.

11. The dispenser as in claim 1, wherein said module further comprises an anti-stuff mechanism disposed generally adjacent a top thereof, said anti-stuff mechanism restricting the height of a stack of sheets loaded into said module.

12. The dispenser as in claim 11, wherein said anti-stuff feature comprises a top plate that automatically moves to a reduced vertical height in said module upon movement of said module to said refill position, and is automatically released from said reduced vertical height upon said module moving to said loaded position.

13. The dispenser as in claim 12, wherein said top plate is moved to the reduced vertical height by at least one cam mounted on said module, said housing having a cam surface engaged by said cam upon movement of said module to said loaded position to release said top plate from the reduced vertical height position.

14. The dispenser as in claim 13, wherein said cam is spring loaded to said reduced vertical height of said top plate.

15. The dispenser as in claim 1, wherein said module further comprises a movable stack lift mechanism disposed adjacent said bottom surface thereof whereby at least a forward facing portion of the stack of sheets is positioned on top of said lift mechanism in said refill position of said module, said lift mechanism automatically movable from a first position adjacent said bottom surface to a second position displaced vertically upwards from said bottom surface upon movement of said module to said loaded position so as to move at the stack of sheets upwards within said module.

16. The dispenser as in claim 15, wherein said stack lift mechanism comprises a bar disposed across the width of said module forward of said dispensing throat.

17. The dispenser as in claim 16, wherein said bar includes side arms pivotally mounted to respective sides of said module, said side arms engaged and moved by cam surfaces defined on said housing upon movement of said module to said loaded position.

18. The dispenser as in claim 1, wherein said dispensing throat comprises a generally trapezoidal shape, a wider width side of said trapezoidal shape oriented towards a back of said housing.

19. A dispenser for dispensing individual sheets from a stack of sheets loaded in the dispenser, comprising:

an external housing defining an internal compartment, said housing having a back wall, side walls, a front, and a bottom opening;

a module slidably received in said compartment through said opening, said module having a back wall, side walls, a substantially open front side, and a bottom surface having a dispensing throat defined therein, said module sized for receipt of a stack of folded sheets to be dispensed from said dispenser;

at least one of said module walls slidably and interlockingly engaged with a corresponding wall of said housing so that said module is movable vertically within said compartment between a loaded position wherein said module is inserted substantially entirely within said compartment with said dispensing throat accessible to a user through said bottom opening, and a refill position wherein said module is slid vertically down and out of said compartment without being completely removed from said housing for reloading said module with a refill stack of the sheets;

a latch mechanism operably disposed between said module and said housing, said latch mechanism releasably holding said module within said housing at said loaded position;

an anti-stuff mechanism configured on said module that restricts the height of a stack of sheets loaded into said module; and a movable stack lift mechanism disposed adjacent said bottom surface of said module whereby at least a forward facing portion of the stack of sheets is positioned on top of said lift mechanism in said refill position of said module, said lift mechanism automatically movable from a first position adjacent said bottom surface to a second position displaced vertically upwards from said bottom surface upon movement of said module to said loaded position so as to move at the stack of sheets upwards within said module.

20. The dispenser as in claim 19, wherein said anti-stuff feature comprises a top plate that automatically moves to a reduced vertical height in said module upon movement of said module to said refill position, and is automatically released from said reduced vertical height upon said module moving to said loaded position, said plate engaged and moved to the reduced vertical height position by at least one cam element mounted on said module, said cam element slides against a cam surface defined one of said walls of said housing as said module is moved to said loaded position to release said top plate from the reduced vertical height position.

21. The dispenser as in claim 19, wherein said stack lift mechanism comprises a bar disposed across the width of said module forward of said dispensing throat, said bar including side arms pivotally mounted to respective sides of said module, said side arms engaged and moved by cam surfaces defined on said housing upon movement of said module to said loaded position.

22. A module for use in combination with a dispenser housing to dispense a stack of folded sheet products wherein the housing defines an internal compartment configured for receipt of the module through an opening in a bottom of the housing, said module comprising:

a bottom surface, and walls defining a stack location for receipt of a stack of folded sheet products;

a dispensing throat defined in said bottom surface;

one of a protrusion and a channel provided on at least one of said walls, said protrusion or channel slidingly engageable with a complimentary channel or protrusion provided on a wall of the housing such that said module is slidable vertically within the housing;

a releasable latch configured on one said wall generally adjacent said bottom surface, said latch releasably engageable with a complimentary recess provided in the dispenser housing to hold said module at a loaded position within the housing, said latch accessible from a front side of said module; and a cam activated anti-stuff mechanism located generally at the top of said stack location.

23. The module as in claim 22, wherein said one of a protrusion and channel is defined on a back wall of said module.

24. The module as in claim 23, comprising a resilient protrusion defined on said back wall generally nearer a top of said module, said resilient protrusion engageable in a complimentary channel defined in a back wall of the housing.

25. The module as in claim 22, wherein said anti-stuff mechanism comprises a plate member automatically movable from a loaded vertical height in said module to a reduced vertical height upon withdrawal of said module from the dispenser housing.

26. The module as in claim 25, further comprising at least one cam member mounted on an external side of one of said walls, said cam member engaging and holding said plate member at the reduced height position until the module is inserted into a housing.

27. The module as in claim 26, wherein said cam is spring loaded to said reduced vertical height position of said plate member.

28. The module as in claim 22, further comprising a movable stack lift mechanism disposed adjacent said bottom surface whereby at least a forward facing portion of the stack of sheets is.positioned on top of said lift mechanism upon the stack being loaded into said module, said lift mechanism automatically movable from a first position adjacent said bottom surface to a second position displaced vertically upwards from said bottom surface upon insertion of said module into the dispenser housing.

29. The module as in claim 28, wherein said stack lift mechanism comprises a bar disposed across the width of said module forward of said dispensing throat.

30. The module as in claim 29, wherein said bar includes side arms pivotally mounted to respective side walls of said module, said side arms engageable by cam surfaces defined on said housing upon insertion of said module into the dispenser housing.

31. A dispenser for dispensing individual sheets from a stack of sheets loaded in the dispenser, comprising:

a frame defining an internal stack location for receipt of a stack of folded sheet products;

a bottom surface against which the stack of sheet products rests, said bottom surface having a dispensing throat defined therein;

a movable stack lift mechanism disposed adjacent said bottom surface whereby at least a forward facing portion of the stack of sheets is positioned on top of said lift mechanism upon the stack being loaded into said module, said lift mechanism engaged by a movable component of said frame and automatically movable from a first position adjacent said bottom surface to a second position displaced vertically upwards from said bottom surface upon movement of said movable component to configure said dispenser for operation.

32. The dispenser as in claim 31, wherein said stack lift mechanism comprises a bar disposed generally across the width of said bottom surface forward of said dispensing throat.

33. The dispenser as in claim 32, wherein said bar includes pivotally mounted side arms, and said movable component comprises cam surfaces that contact and move said side arms.

34. The dispenser as in claim 31, wherein said frame comprises a housing having an internal compartment with a bottom opening therein, and a module slidably received in said compartment through said opening, said module sized for receipt of a stack of folded sheets to be dispensed, said bottom surface defined by said module, said lift mechanism provided on said module and activated by insertion of said module into said housing.

* * * * *